US012305449B2

(12) United States Patent
Alzaki et al.

(10) Patent No.: US 12,305,449 B2
(45) Date of Patent: May 20, 2025

(54) REAMER DRILL BIT

(71) Applicant: Saudi Arabian Oil Company, Dhahran (SA)

(72) Inventors: Hussien A. Alzaki, Saihat (SA); Mohammed Y. Al Daif, Al Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 16 days.

(21) Appl. No.: 17/326,614

(22) Filed: May 21, 2021

(65) Prior Publication Data

US 2022/0372823 A1 Nov. 24, 2022

(51) Int. Cl.
*E21B 10/32* (2006.01)
*E21B 10/61* (2006.01)

(52) U.S. Cl.
CPC ..... *E21B 10/322* (2013.01); *E21B 10/61* (2013.01)

(58) Field of Classification Search
CPC ..... E21B 10/32; E21B 10/322; E21B 10/265; E21B 10/325
See application file for complete search history.

(56) References Cited

U.S. PATENT DOCUMENTS 782,320 A * 2/1905 Brewster ..... E21B 10/32 82/1.4
1,166,535 A * 1/1916 Munsinger ..... E21B 10/325 175/278
1,478,306 A * 12/1923 Sweetman ..... E21B 10/322 175/269
1,485,249 A * 2/1924 Craig ..... E21B 10/325 175/290
1,764,373 A * 6/1930 Wells ..... E21B 10/325 175/283
1,981,262 A * 11/1934 Burt ..... E21B 10/322 92/240
2,043,225 A 6/1936 Armentrout et al.
(Continued)

FOREIGN PATENT DOCUMENTS

AU 2012231398 9/2012
CA 2158903 3/1996
(Continued)

OTHER PUBLICATIONS

Dictionary definition of "groove", accessed via thefreedictionary.com on Jan. 20, 2023.*
(Continued)

*Primary Examiner* — Blake Michener
(74) *Attorney, Agent, or Firm* — Fish & Richardson P.C.

(57) ABSTRACT

A reamer drill bit includes a body having an outer surface defining a plurality of grooves, and a cutter arm with an interior surface. Each groove extends from a first end of the body to a second end of the body and has at least one groove recess, at least one groove peak connected by a sloped section, and a track arranged in the sloped section. The cutter arm is slidably attached to the body, is configured to expand radially away from the body, and is configured to slide longitudinally relative to the body along the track. The interior surface of the cutter arm includes at least one arm valley, and at least one arm protrusion. The at least one groove recess receives the at least one arm protrusion and the at least one arm valley receives the at least one groove peak.

27 Claims, 8 Drawing Sheets

(56) References Cited

U.S. PATENT DOCUMENTS 2,227,729 A 1/1941 Lynes
2,602,642 A * 7/1952 Baker ..... E21B 10/322 175/269
3,365,010 A * 1/1968 Howell ..... E21B 10/32 175/286
3,556,233 A * 1/1971 Gilreath ..... E21B 10/322 175/267
3,851,719 A 12/1974 Thompson et al.
4,316,506 A 2/1982 Poole
4,565,252 A * 1/1986 Campbell ..... E21B 10/322 175/269
RE32,345 E 3/1987 Wood
4,936,721 A 6/1990 Meyer
5,111,893 A * 5/1992 Kvello-Aune ..... E21B 7/20 175/269
5,163,522 A 11/1992 Eaton et al.
5,271,472 A 12/1993 Leturno
5,361,859 A * 11/1994 Tibbitts ..... E21B 10/66 175/286
5,803,186 A 9/1998 Berger et al.
6,047,239 A 4/2000 Berger et al.
6,330,913 B1 12/2001 Langseth et al.
6,622,554 B2 9/2003 Manke et al.
6,920,944 B2 * 7/2005 Eppink ..... E21B 10/325 175/269
7,086,463 B2 8/2006 Ringgenberg et al.
7,124,819 B2 10/2006 Ciglenec et al.
7,293,616 B2 * 11/2007 Tulloch ..... E21B 10/322 175/269
7,647,980 B2 1/2010 Corre et al.
8,122,977 B2 * 2/2012 Dewey ..... E21B 10/322 175/62
8,162,080 B2 4/2012 Castillo
8,201,642 B2 6/2012 Radford et al.
8,281,882 B2 10/2012 Hall et al.
9,051,810 B1 6/2015 Cuffe et al.
9,238,961 B2 1/2016 Bedouet
9,494,010 B2 11/2016 Flores
9,701,042 B2 7/2017 Moller et al.
10,119,350 B2 * 11/2018 Lehr ..... E21B 23/0418
10,294,728 B2 5/2019 McCarthy et al.
2002/0066563 A1 6/2002 Langseth et al.
2002/0070052 A1 * 6/2002 Armell ..... E21B 10/322 175/406
2003/0164251 A1 * 9/2003 Tulloch ..... E21B 10/32 175/325.1
2003/0183424 A1 * 10/2003 Tulloch ..... E21B 10/322 175/263
2004/0124011 A1 * 7/2004 Gledhill ..... E21B 10/322 175/57
2004/0256113 A1 * 12/2004 LoGiudice ..... E21B 41/00 166/381
2005/0022987 A1 2/2005 Green et al.
2005/0133267 A1 6/2005 Reid et al.
2006/0118339 A1 * 6/2006 Takhaundinov ..... E21B 10/322 175/267
2006/0248949 A1 11/2006 Gregory et al.
2007/0007043 A1 * 1/2007 Dewey ..... E21B 10/32 175/57
2007/0089912 A1 * 4/2007 Eddison ..... E21B 10/32 175/269
2008/0053652 A1 3/2008 Corre et al.
2008/0236897 A1 * 10/2008 Lee ..... E21B 17/1021 175/284
2009/0095532 A1 * 4/2009 Laird ..... E21B 7/28 175/57
2009/0285638 A1 11/2009 Lundberg et al.
2010/0006339 A1 1/2010 Desai
2010/0089583 A1 * 4/2010 Xu ..... E21B 47/13 175/57
2011/0155368 A1 6/2011 El-Khazindar
2012/0031671 A1 2/2012 Propes
2013/0056276 A1 3/2013 Rousseau et al.
2013/0256034 A1 * 10/2013 Poteet, III ..... E21B 7/28 175/57
2014/0300895 A1 10/2014 Pope et al.
2015/0027724 A1 1/2015 Symms
2015/0090494 A1 * 4/2015 Lazarev ..... G06K 19/07773 175/40
2018/0266186 A1 9/2018 Burca et al.
2019/0292852 A1 9/2019 Marshall et al.
2021/0140244 A1 * 5/2021 Wang ..... E21B 10/322
2021/0189871 A1 * 6/2021 Blackman ..... E21B 47/125

FOREIGN PATENT DOCUMENTS

CA 2249432 9/2005
CA 2594042 8/2012
EP 2596205 5/2019
WO WO 1997021904 6/1997
WO WO 2002020944 3/2002
WO WO 2017196303 11/2017

OTHER PUBLICATIONS

Schlumberger, "CERTIS: Retrievable, single-trip, production-level isolation system," www.slb.com/CERTIS, 2017, 2 pages.
Weatherford, "RFID Advanced Reservoir Management System Optimizes Injection Well Design, Improves Reservoir Management," Weatherford.com, 2013, 2 pages.
Wellbore Service Tools: Retrievable tools, "RTTS Packer," Halliburton: Completion Tools, 2017, 4 pages.

* cited by examiner

REAMER DRILL BIT

TECHNICAL FIELD

This disclosure related to an expandable drill bit for drilling and reaming operation.

BACKGROUND

Under-reaming is an essential part of well drilling operation across reactive formations or special casing design. Under-reaming allows a casing to be run to a desired point. In some cases, if under reaming was not performed, several reaming trips are performed to increase the chance of success of running the casing. Performing several reaming trips keeps the formation open and un-cased for a period of time, which can also cause some formation to react and swell resulting in tight spots while running the casing that might lead unsuccessful operations. Under reaming occurs after drilling a small pilot hole in a separate run or occurs while drilling with an under reamer arranged in the Bottom hole assembly (BHA).

SUMMARY

In certain aspects, a reamer drill bit to form a wellbore includes a body having an outer surface defining a plurality of grooves, each groove extending from a first end of the body to a second end of the body. The grooves each include at least one groove recess, at least one groove peak connected by a sloped section, and a track arranged in the sloped section. A cutter arm of the reamer drill bit is configured to expand radially away from the body. The cutter arm is also slidably attached to the body and configured to slide longitudinally relative to the body. Each cutter arm has an interior surface with at least one arm valley, and at least one arm protrusion. The at least one groove recess receives the at least one arm protrusion and the at least one arm valley receives the at least one groove peak. The cutter arm is configured to slide longitudinally along the track.

In some embodiments, the sloped section includes a recessed track extending from a first end at the at least one groove recess to a second end at the at least one groove peak. The interior surface of the cutter arm can include a cam configured to engage with the recessed track of the body. The second end of the track can include a (first) lock configured to lock the cam to the second end of the track and/or in an expanded position. The reamer drill bit can also include a second lock configured to hold the cutter arm in a retracted position.

Some reamer drill bits include a central axis and the reamer drill bit is centered on the axis.

The first end of the sloped section may be radially closer to the axis than the second end of the sloped section.

In some cases, the interior surface of the cutter arm includes a recessed track configured to engage with a cam disposed on the peak of the grooves of the body. The track can extend from a first end to a second end.

In some embodiments, each of the plurality of grooves include a second recess and a second peak.

In some reamer drill bits, the cutter arm further includes a cutting surface opposite the interior surface. The cutting surface may be perpendicular to the interior surface.

In some cases, the body further includes a plurality of outlets defined in each of the grooves of the body. The plurality of outlets can be connected to a fluid source and a pump configured to convey fluid from the fluid source to the outlets. In some cases, the plurality of outlets connect to the fluid source via a fluid tubing in the body. The plurality of outlets may include a first outlet defined in the first groove recess of the body. Some plurality of outlets have a second outlet defined in a second recess of each groove of the outer surface of the body.

In some cases, the reamer drill bit also includes an actuation sub-assembly configured to open and close the fluid tubing. The actuation sub-assembly may include an activation port configured to open or close based on an actuator. The actuator can be a ball, down-link or and radio frequency identification chip.

In some cases, the body also includes at least one nozzle at the second end of the body fluidly connected to a fluid source. The nozzle can be fluidly connected to the fluid source via nozzle tubing.

Some plurality of grooves are toothed grooves and/or wavy grooves.

In certain aspects, a method to expand a cutter arm of a reamer drill bit includes unlocking, by an actuation sub-assembly, a lock connecting the cutter arm of the drill reamer bit to a body of the drill reamer bit. The cutter arm extends along a first end of the reamer drill bit to a second end of the reamer drill bit. The method also includes opening, by the actuation sub-assembly, a fluid channel fluidly connected to a fluid source. The fluid channel extends to an outlet at an outer surface of a body of the reamer drill bit. An interior surface of a cutter arm is slidably attached to the body covers the outlet. The method also includes flowing high pressure fluid through the outlet to push the cutter arm radially outward away from the body.

In some cases, the method also includes locking, by a second lock arranged in a track of a sloped section of the body, the cutter arm to the body in an extend position.

Opening, by the actuation sub-assembly, the fluid channel fluidly connected to the fluid source can include receiving an actuation signal from an actuator. The actuator can be a ball, an IFRD signal, or a down-link signal.

In some cases, opening, by the actuation sub-assembly, the fluid channel fluidly connected to the fluid source includes opening a plurality of fluid channels fluidly connected to the fluid source.

In some embodiments, the method also includes translating the reamer drill bit such the cutter arm receives a downhole force that translates the cutter arm along a track of a sloped section of the body.

In some cases, flowing high pressure fluid through the outlet to push the cutter arm radially outward, includes flowing high pressure fluid through a plurality of outlets arranged on the outer surface of the body.

In some methods, the high pressure fluid has a pressure of 300 psi to 750 psi.

Some methods also include flowing fluid from the fluid source to a nozzle disposed on the second end of the reamer drill bit.

The details of one or more embodiments of the invention are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

This disclosure relates to a reamer drill bit with expandable and retractable cutter arms. The cutter arms are configured to drill both the pilot hole and ream the opening of the wellbore for a casing, thereby reducing the time that a newly formed wellbore remains uncased and reducing the likelihood of swelling. If the uncased wellbore does swell, the some drill bit can be constricted from moving by tight spots. The reamer drill bit can reduce the risk of the drill bit being trapped within a swollen un-cased wellbore because the expandable arms can re-ream the swollen wellbore from the floor of the wellbore. The downhole tool can then be removed. This configuration also reduces operation run time by drilling and reaming the wellbore in a single run and reduces the likelihood of broken components that can occur when removing a downhole tool from a swollen un-cased wellbore.

Figure 1:
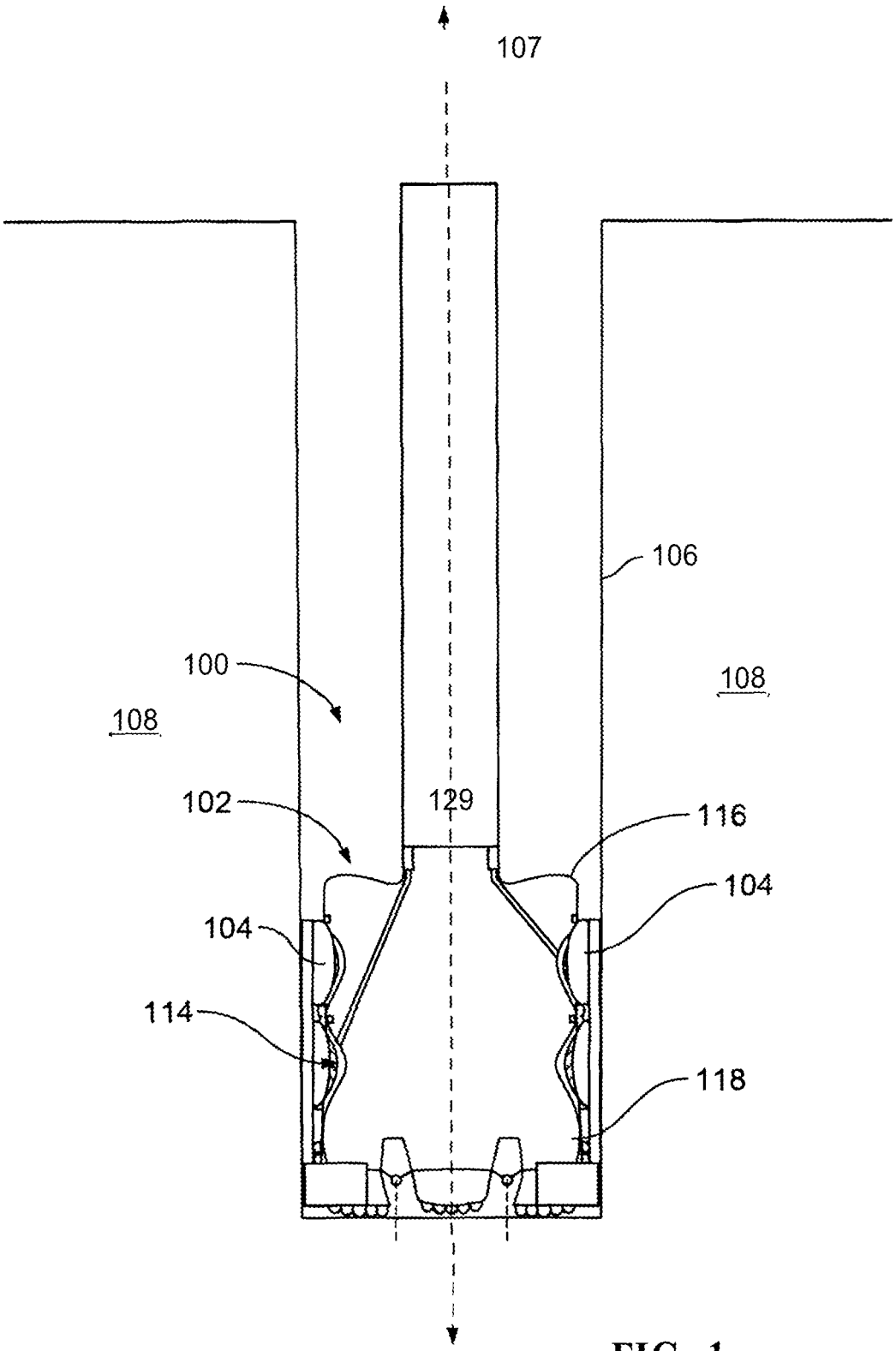
FIG. 1 is a cross sectional view of a downhole tool having a reamer drill bit with cutter arms in a retracted position.

FIG. 1 is a cross sectional view of a downhole tool 100 having a reamer drill bit 102 with cutter arms 104 in a retracted position. The downhole tool 100 is arranged in a wellbore 106 defined by a formation 108. The reamer drill bit 102 is shown during drilling operations in the retracted position. The reamer drill bit 102 is configured to form the wellbore 106 in the formation at a predetermined diameter. The reamer drill bit 102 is centered on an axis 107. After the wellbore 106 is drilled, the reamer drill bit 102 may expand to expand (ream) the wellbore 106 to a larger diameter relative to the axis 107 to prepare the wellbore 106 for a casing. The transition from the retracted position to the extended position is described further with reference to FIGS. 4A-4C.

Figure 2:
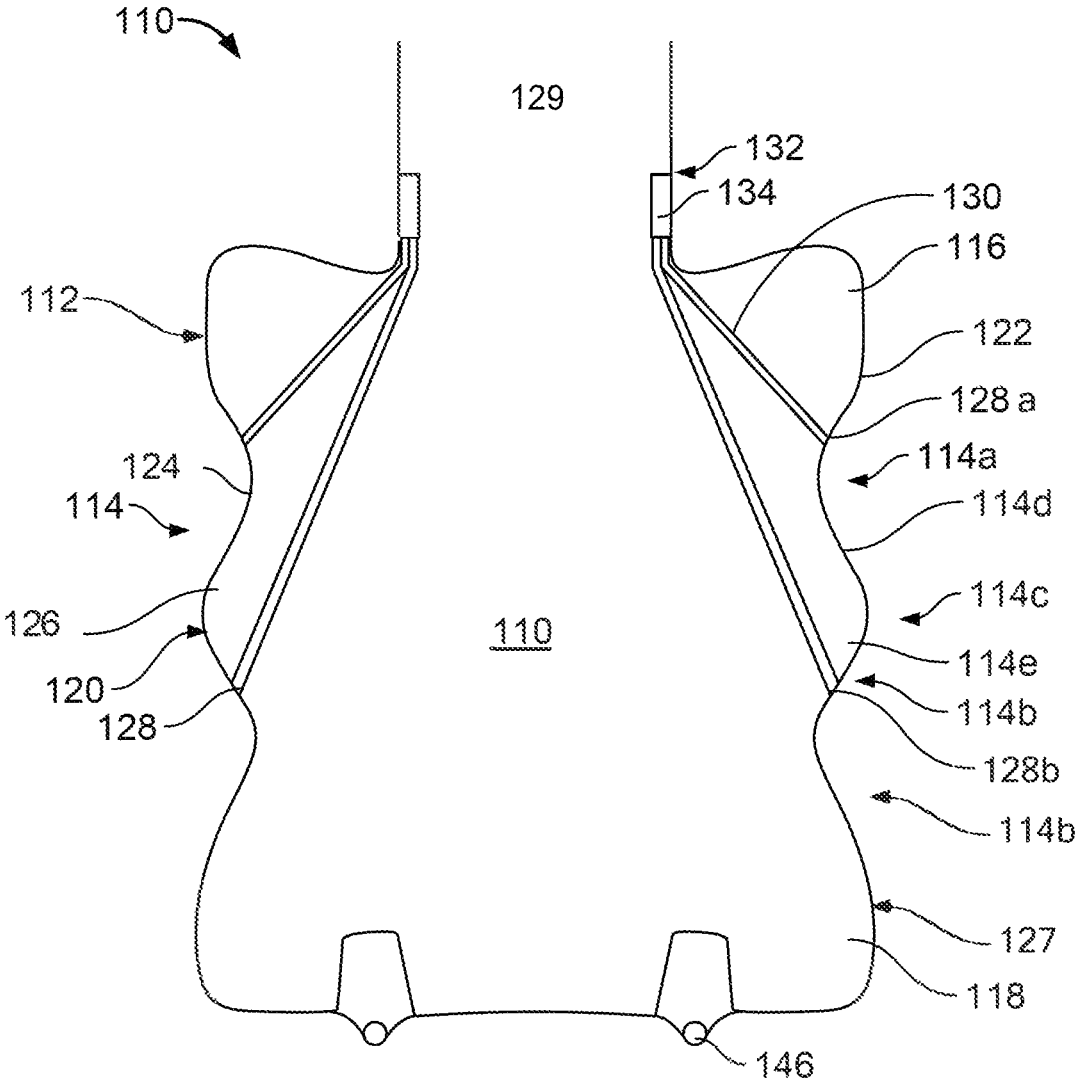
FIG. 2 is a cross sectional view a body of the reamer drill bit.

FIG. 2 is a cross sectional view a body 110 of the reamer drill bit 102. The body has an outer surface 112 defining a plurality of grooves 114. Each groove 114 extends from a first end 116 of the body 110 to a second end 118 of the body 110. The grooves have a first (uphole) (groove) recess 114*a*, a second (downhole) (groove) recess 114*b*, and a (groove) peak 114*c* arranged between the first recess 114*a* and second recess 114*b*. Each groove 114 also includes a first sloped section 114*d* connecting the first recess 114*a* and the peak 114*c* and a second sloped section connecting the peak 114*c* and the second recess 114*b*. In some cases, the grooves are toothed or wavy.

Figure 4A:
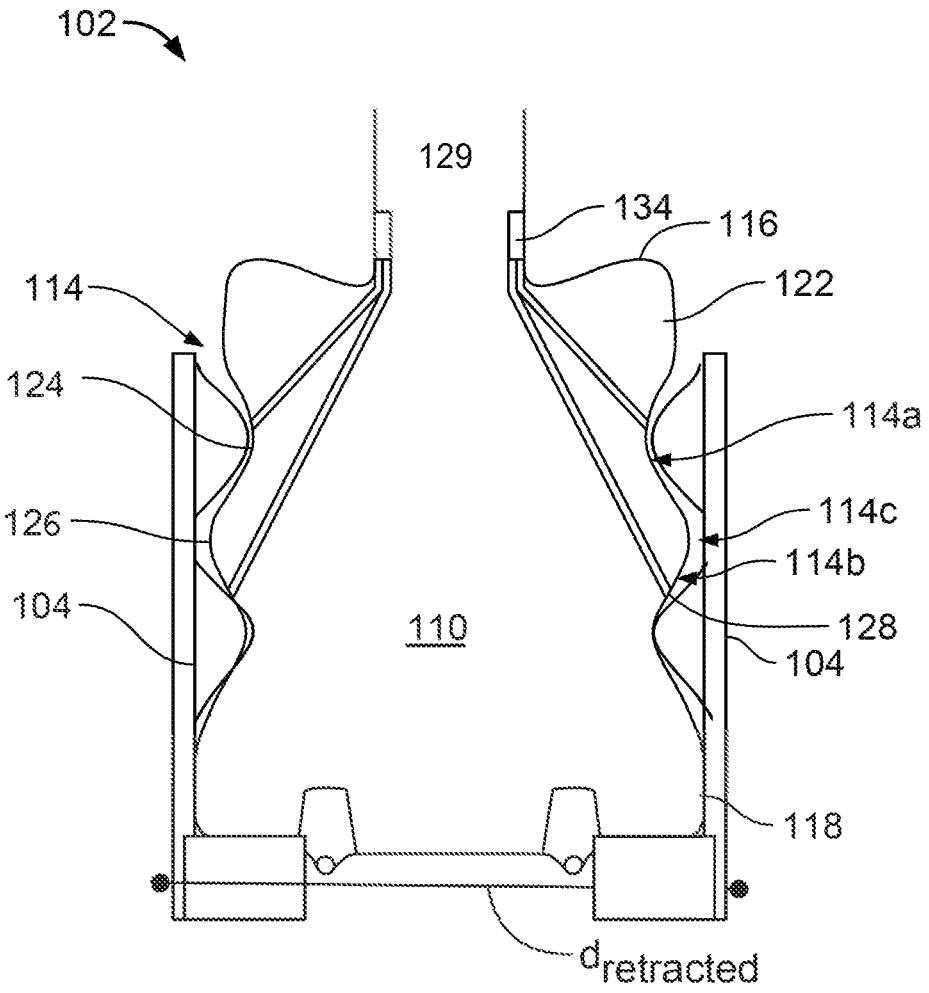
FIG. 4A is a cross sectional view the reamer drill bit with cutter arms in a retracted position.
Figure 4B:
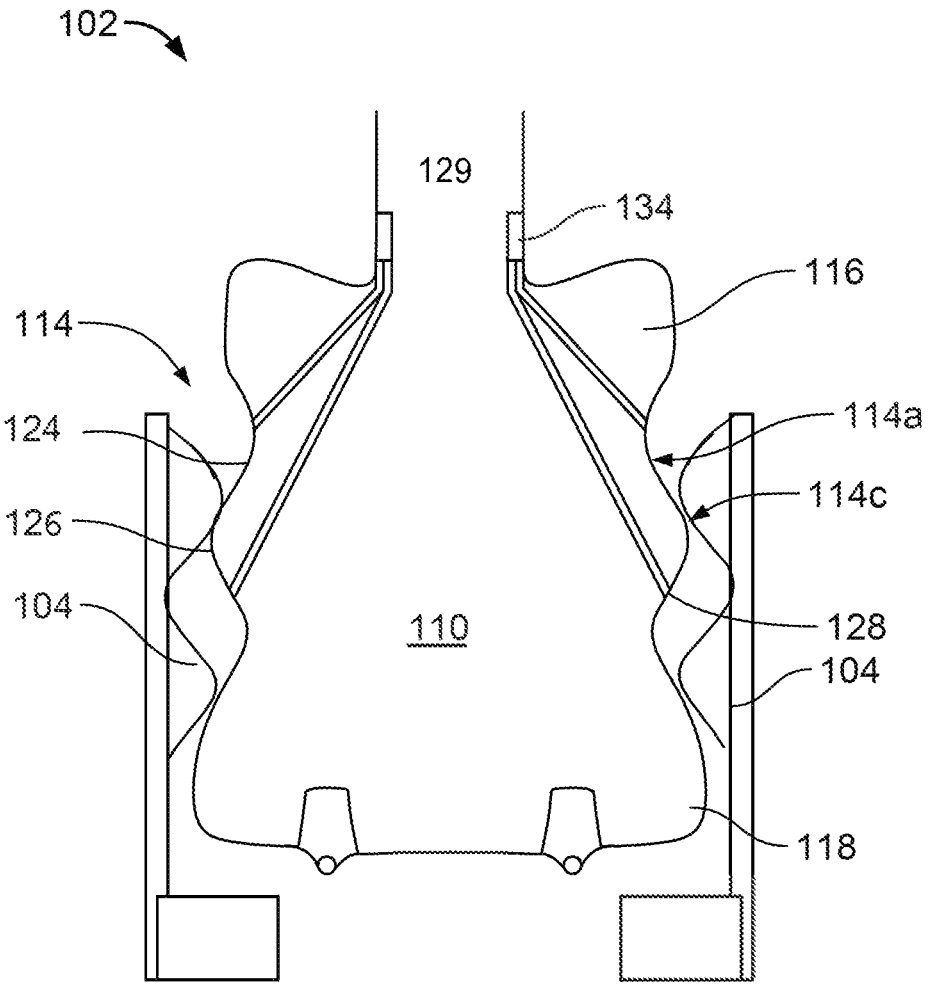
FIG. 4B is a cross sectional view of the reamer drill bit with the cutter arms transitioning from the retracted position to an extended position.
Figure 4C:
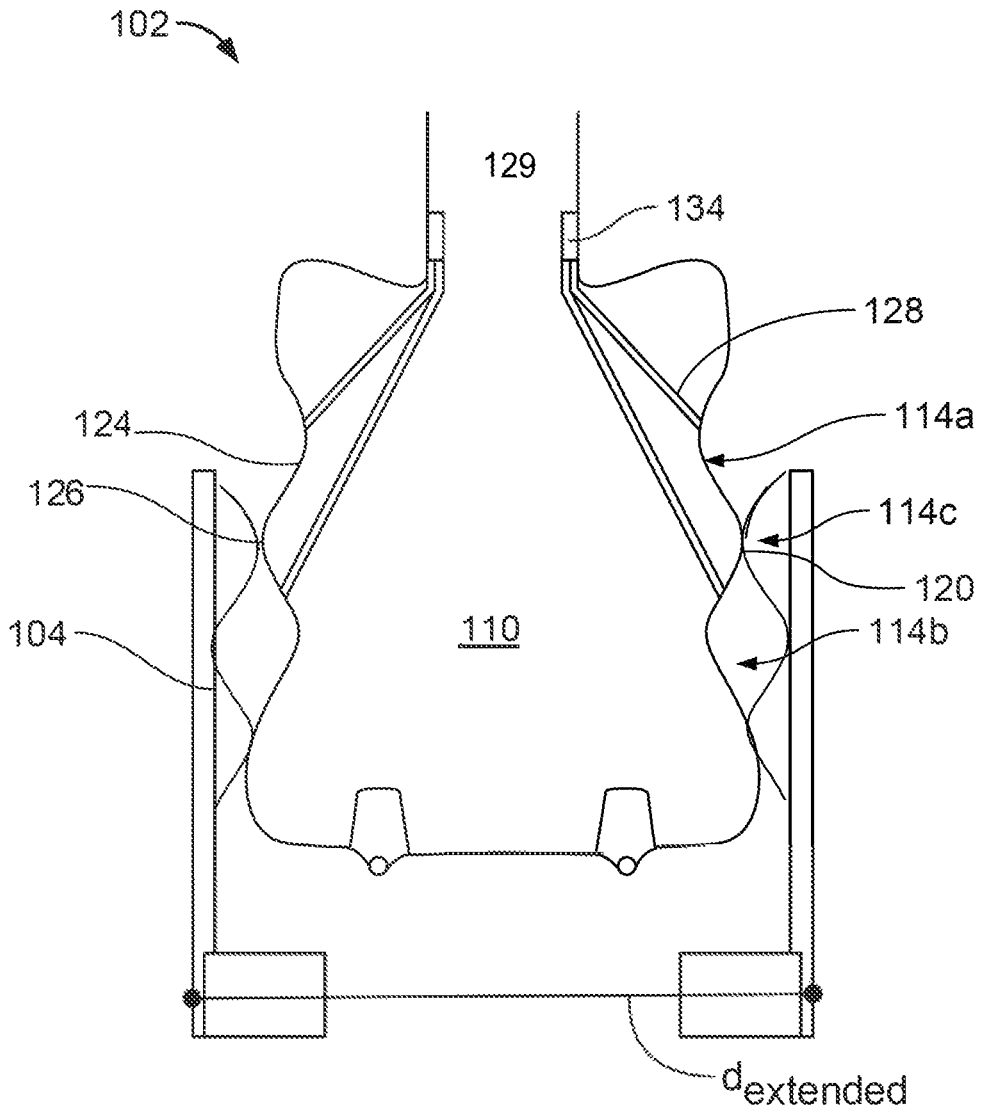
FIG. 4C is a cross sectional view of the reamer drill bit with the cutter arms in the extended position.

A first lock 120 is arranged on each peak 114*c* to lock the cutter arm 104 in the extended position, shown in FIG. 4C. A second lock 122 is arranged on the outer surface 112 of the body 110, for example, at the first end 116 of the body. The second lock 122 holds the cutter arm 104 in the retracted position, shown in FIG. 4A. In some cases, the first and/or second lock can be arranged on the cutter arm.

The first sloped section 114*d* defines a recessed track (not shown) that extends from a first (end) point 124 at the first recess 114*a* of the groove 114 to a second (end) point 126 at the peak 114*c* of the groove 114 to a third (end) point 127 at the second recess 114*b* of the groove 114. The first point 124 of the first sloped section 114*d* is radially closer to the axis 107 than the second point 126 of the first sloped section 114*d*. The first lock 120 is arranged at the second point 126 and is configured to lock a cam (not shown) of the cutter arm 104.

The outer surface 112 of the body 110 defines multiple outlets 128 in each groove 114 of the body 110. A first outlet 128*a* is arranged in the first recess 114*a* and a second outlet 128*b* is arranged in the second recess 114*b*. The outlets 128 are fluidly connected to a fluid source 129 via a fluid tubing 130. A pump (not shown) is configured to convey fluid from the fluid source 129 to the outlets 128.

The body 110 further includes an actuation sub-assembly 132 having an actuation port 134 arranged at an opening of the fluid tubing 130. The actuation port 134 controls the inflow of fluid to the outlets 128. The actuation sub-assembly 132 is configured to open or close the fluid tubing 130. When closed, the actuation port 134 prevents fluid communication between the fluid source 129 and the outlets 128. When open, the actuation port 134 fluidly connects the fluid source 129 and the outlets 128. The actuation sub-assembly 132 also includes an actuator (not shown) that opens or closes the actuation port 134. The actuator can be a ball, down-link, or radio-frequency ID chips (RFID).

The body 110 also includes nozzles 146 arranged at the second end 118 of the body 110. The nozzles 146 are fluidly connected to the fluid source 129 and are configured to spray fluid onto the floor of the wellbore 106.

Figure 3:
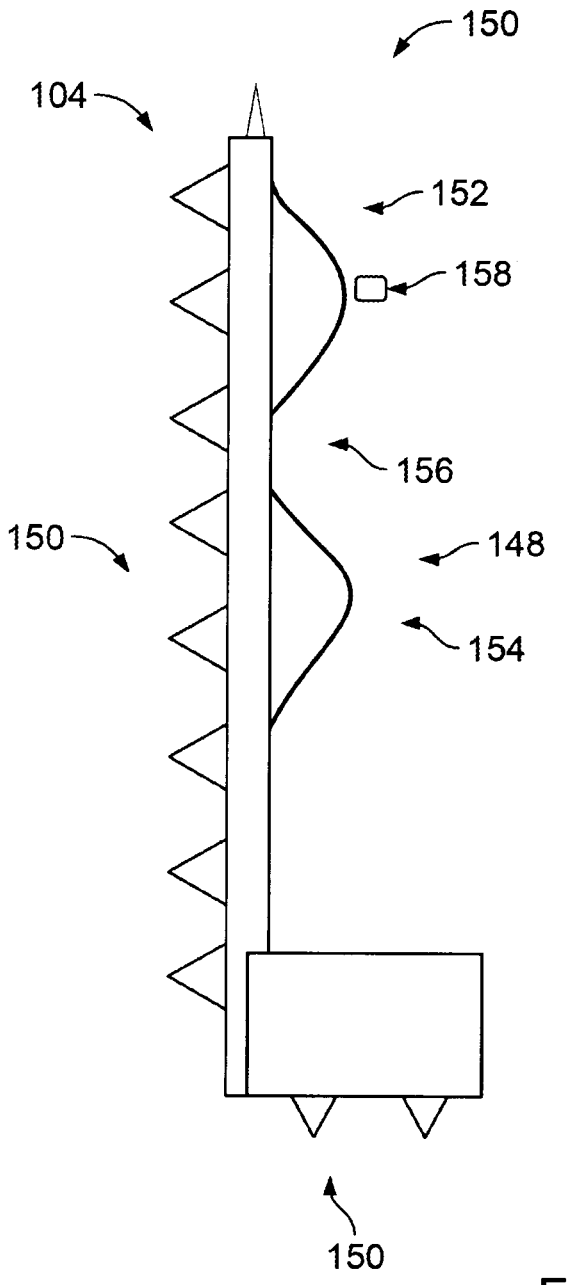
FIG. 3 is a cross sectional view of the cutter arm of the reamer drill bit.

FIG. 3 is a cross sectional view of the cutter arm 104 of the reamer drill bit 102. The cutter arm 104 is configured to mate with the groove 114 of the body 110 in a retracted position and expand radially away from the body 110 in an extended position. The cutter arm 104 is slidably attached to the body 110 and configured to slide longitudinally relative to the body 110. Some reamer drill bits have multiple cutter arms, for example two, three, four, five six, seven, eight, nine, or ten cutter arms. Each cutter arm 104 has an interior surface 148 and a cutting surface 150, opposite the interior surface 148. The cutting surface 150 is also arranged perpendicular to the interior surface 148. The cutting surface 150 is configured to cut the formation to form the wellbore 106, to enlarge the wellbore 106, and/or to cut a swollen wellbore.

The cutter arm 104 includes a first protrusion 152, a second protrusion 154, and a valley 156 arranged between the first protrusion 152 and second protrusion 154. The first protrusion 152 has a cam 158 extending from the first protrusion 158, for example from a peak of the first protrusion. The track in the groove 114 engages the cam 158 such that the cam 158 follows the track as the cutter arm 104 moves longitudinally from the first end 116 of the body 110 towards the second end 118 of the body 110. The cutting surface 150 can include spikes or teeth to cut the formation. The first lock of the body may lock the cam and/or the first protrusion. The first protrusion can also include a latch to engage with the second lock so that the cutter arms 104 remain in the retracted position.

FIG. 4A is a cross sectional view the reamer drill bit 102 with the cutter arms 104 in a retracted position. In the retracted position, the first recess 114*a* of the groove 114 receives the first protrusion 152 of the cutter arm 104, the second recess 114*b* of the groove 114 receives the second protrusion 154 of the cutter arm 104, and the valley 156 of the cutter arm 104 receives the peak 114*c* of the groove 114. The cam 158 is arranged at the first point 124 of the track. In this configuration, the interior surface 148 of the cutter arm mates with the outer surface 112 of the body 110. The actuation port 134 of actuation sub-assembly 132 is closed and no fluid exits the outlets 128 defined in the grooves 114.

When the cutter arms 104 are in the retracted position, the reamer drill bit 102 has a diameter $d_{retracted}$. The second lock 122 is engaged with the cutter arm 104 so that the cutter arm 104 is longitudinally constrained relative to the body 110 and the cam 158 is prevented from translating along the track. This reamer drill bit 102 is in the retracted configuration during drilling operations, which can include drilling and transportation uphole and/or downhole. The cutter arms 104 extend radially as the cutter arm 104 translates longitudinally from the first end 116 of the body 110 to the second end 118 of the body 110.

FIG. 4B is a cross sectional view of the reamer drill bit 102 with the cutter arms 104 transitioning from a retracted position to an extended position. The second lock 122 is unlocked and the actuation port 134 is opened so that fluid flows from the fluid source 129 to the outlets 128 at a high pressure. The fluid may have a pressure between about 200 psi and about 850 psi over the standard pipe pressure, e.g., between about 300 psi and about 750 psi over the standard pipe pressure, about 400 psi and about 650 psi, about 500 psi to about 600 psi over the standard pipe pressure, about 600 psi to about 800 psi over the standard pipe pressure, about 300psi to about 400 psi over the standard pipe pressure, about 300 psi to about 500 psi over the standard pipe pressure, about 400 psi to about 750 psi over the standard pipe pressure, about 300psi to about 700 psi over the standard pipe pressure, or about 350 psi to about 650 psi over the standard pipe pressure. Since the second lock 122 is unlocked, the cam 158 is free to translate along the track. The fluid pressure pushes the cutter arm 104 radially, however, due to the engagement with the cam 158 and track, the cutter arm 104 moves both longitudinally from the first point 124 of the track to the second point 126 of the track and moves radially away from the body 110 as the first point 124 of the track is radially closer to the axis 107 than the second point 126 of the track. The fluid pressure continues to push the cutter arm 104 radially and longitudinally along the track until the cam 158 reaches the second point 126 of the track at the peak 114*c* of the groove 114.

FIG. 4C is a cross sectional view of the reamer drill bit 102 with cutter arms 104 in the extended position. In the extended position, the cam 158 is locked, by the first lock 120, to the peak 114*c* of the groove 114. The actuation port 134 of actuation sub-assembly 132 is closed so that no fluid exits the outlets 128 in the groove 114. The lock 120 is configured to hold the cutter arms 104 in the extended position against any drilling or reaming forces. In some cases, the first lock prevents the cam from translating past the peak towards the second end of the body, but does not prevent the cam from translating towards the first end of the body, along the sloped section of the groove. In some reamer drill bits, the actuation port is open when the cutter arms are in the extended position and a constant stream of fluid exits the outlets to apply constant pressure to the cutter arms so that the cutter arms remain in the extended position.

When the cutter arms 104 are in the extended position, the reamer drill bit 102 has a diameter $d_{extended}$. The first lock 120 is engaged with the cutter arm 104 so that the cutter arm 104 is longitudinally constrained relative to the body 110 and the cam 158 is prevented from translating along the track. This reamer drill bit 102 is in the extended configuration during reaming operation, which can include reaming, transportation uphole and/or downhole, and cutting a swollen formation. In some cases, the cutter arms are in the extended position, or transitioning from the retracted position to the extended position, during drilling operations. The cutter arms 104 can retract into the retracted position, shown in FIG. 4A if the first lock 120 is disengaged. Upon disengagement of the first lock 120, the cam 158 moves towards the first end 112 of the body 102. In some cases the cam is biased towards the first end 112 of the body 102 so that the cutter arms move into the retracted deposition when the first lock is released. The cam can be biased by a biasing component mounted on the body and/or the cutter arm. The biasing component can be a pattern in the groove (e.g., a slope), a spring, magnet(s), and/or any other biasing component known in the art.

Figure 5:
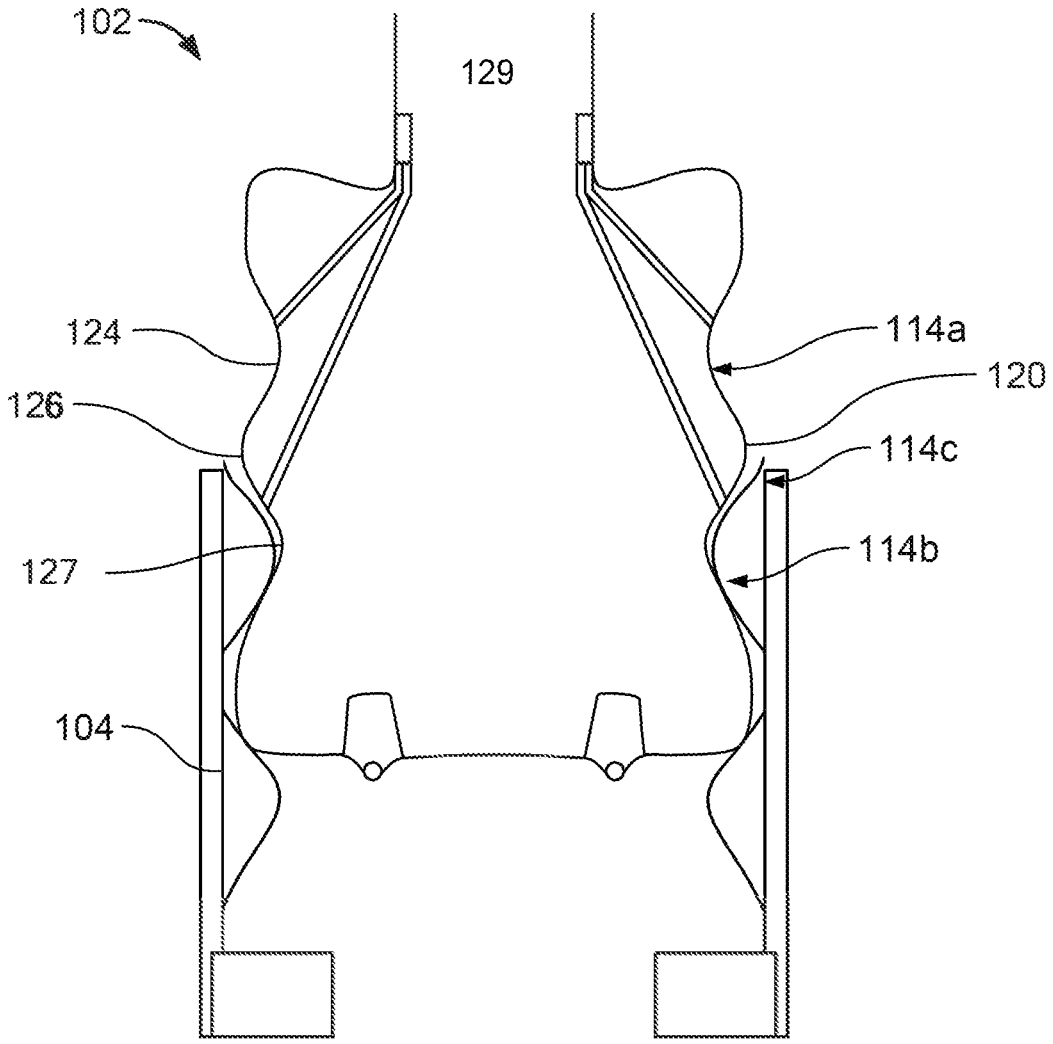
FIG. 5 is a cross sectional side view of the reamer drill bit with the cutter arms in an emergency position.

FIG. 5 is a cross sectional side view of the reamer drill bit 102 with cutter arms 104 in an emergency position. The first lock 120 is formed to withstand drilling and reaming forces, however, in the case that the lock 120 breaks or releases, the cutter arm 104 translates towards the second end 118 of the body 110. The track 114 extends past the second point 126 along the second sloped portion 114*e* to the third point (end) 127 of the track at the second recess 114*b*. A third lock (not shown) may lock the cam 158 to the second recess 114*b* at the third point 127. In this configuration the second recess 114*b* of the groove 114 receives the first protrusion 152 of the cutter arm 104 and the reamer drill bit 102 has the retracted diameter $d_{retracted}$. The downhole tool 100 may be removed from the wellbore 106 if the cutter arm 104 falls into the emergency position.

Figure 6:
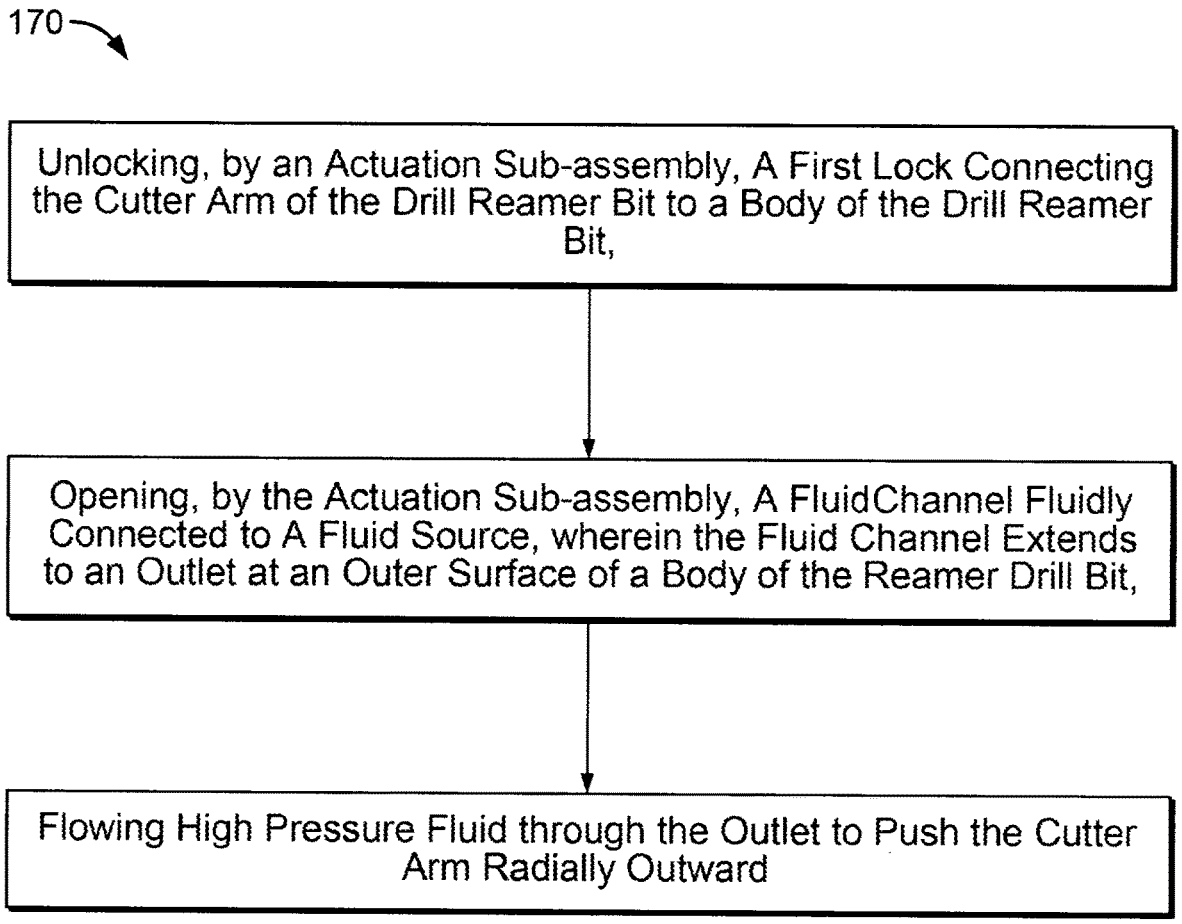
FIG. 6 is a flow chart of a method for expanding cutter arms of a reamer drill bit.

FIG. 6 is a flow chart of a method 170 for expanding cutter arms of a reamer drill bit. The method 170 is described with reference to the reamer drill bit 102, however, the method may be applied to any relevant system or drill bit. The reamer drill bit 102 drills a pilot hole (e.g., a wellbore 106) into the formation 108. When drilling the pilot hole, the cutter arms 104 of the reamer drill bit 102 are in the retracted position, described with reference to FIG. 4A. Fluid from the fluid source 129*s* flows to the nozzles 146 to soften the floor of the wellbore 106. The pilot hole has the diameter $d_{retracted}$. To enlarge the hole and insert a casing, the pilot hole (e.g., wellbore 106) is enlarged by reaming. To ream the wellbore 106, the cutter arms 104 move from the retracted position to the extended position.

To move the cutter arms 104 from the retracted position to the extended position, the actuation sub-assembly 132 is first actuated by receiving a signal from an actuator. The actuator may be an RFID signal received by an RFID chip, a hydraulic actuator, a ball drop actuator, or any other actuator known in the art. After the actuation sub-assembly receives the actuation signal from the actuator, the actuation port 134 is opened and the second lock 122 is disengaged, by the actuation sub-assembly 132. Fluid flows from the fluid source 129 through the fluid tubing 130 to the outlets 128 in the outer surface 112 of the body 110. As the cutter arms 104 are in the retracted position, the interior surface 148 of the cutter arm 104 abuts or mates with the outer surface 112 of the body 110. The high pressure fluid flows through the outlets 128 and pushes the cutter arms 104 radially outward away from the body 110 and axis 107, which is translated to longitudinal movement and radial movement by the track and cam 158 connection. In some cases, the reamer drill bit 102 is translated uphole such the cutter arms 104 receive a downhole force that translates the cutter arms 104 downhole along a track of the first sloped section 114*d* of the body 110. The cam 158 moves from the first point 124 of the track to the second point 126 of the track. The first lock 120 at the second point 126 of the track at the peak 114*c* of the body 110 locks. The lock is prompted to lock or unlock upon receipt of a signal, for example an RFID signal or a pressure signal. When the first lock 120 is locked, the cutter arm 104 is longitudinally and radially constrained to the body in the extend position.

In some cases, the track is defined in the cutter arm and the cam is disposed on the peak of the groove. In such a configuration, the track in the cutter arm receives the cam on the groove.

A number of embodiments have been described. Nevertheless, it will be understood that various modifications may be made without departing from the spirit and scope of the disclosure. Accordingly, other embodiments are within the scope of the following claims.

What is claimed is:

1. A reamer drill bit to form a wellbore, the reamer drill bit comprising:

a fluid connection end;

a free end;

a central axis, wherein the reamer drill bit is centered on the central axis;

a body having a first end and a second end, wherein the body comprises:

an outer surface extending from the first end to the second end, the outer surface comprising:

at least one recess, at least one peak, and a sloped section connecting the at least one recess and at least one peak;

a plurality of outlets defined in the outer surface of the body;

wherein the plurality of outlets are fluidly connected to a fluid source, and a cutter arm configured to expand radially away from the body, wherein the cutter arm is slidably attached to the body and configured to slide longitudinally relative to the body, each cutter arm comprising:

an interior surface comprising:

at least one arm valley, and at least one arm protrusion;

a first cutting surface opposite the interior surface; and a second cutting surface perpendicular to the interior surface wherein the second cutting surface extends axially past the second end of the body along the central axis;

wherein the at least one recess receives the at least one arm protrusion and the at least one arm valley receives the at least one peak.

2. The reamer drill bit of claim 1, wherein the interior surface of the cutter arm comprises a cam configured to engage with the outer surface of the body.

3. The reamer drill bit of claim 1, further comprising a central axis, wherein the reamer drill bit is centered on the axis; wherein the arm covers at least two outlets of the plurality of outlets; wherein the second cutting surface of the cutting surface is perpendicular to the central axis and forms the free end of the reamer drill bit.

4. The reamer drill bit of claim 3, wherein a first end of the sloped section is radially closer to the axis than a second end of the sloped section, wherein at least one outlet of the plurality of outlets is defined in the sloped section.

5. The reamer drill bit of claim 1, wherein the outer surface of the body is configured to engage with a cam disposed on the peak of the at least one arm protrusion of the cutter arm.

6. The reamer drill bit of claim 1, wherein the outer surface of the body comprises a second recess and a second peak.

7. The reamer drill bit of claim 1, wherein the first cutting surface opposite the interior surface comprises teeth or spikes.

8. The reamer drill bit of claim 7, wherein the second cutting surface perpendicular to the interior surface comprises teeth or spikes.

9. The reamer drill bit of claim 1, wherein the body further comprises:

multiple fluid tubings defined in the body, each fluid tubing of the multiple fluid tubings extending from an opening to a corresponding outlet in the plurality of outlets; and an actuation port arranged at the openings of the multiple fluid tubings, wherein the plurality of outlets connect to the fluid source via the fluid tubing in the body when the actuation port is open.

10. The reamer drill bit of claim 9, further comprising an actuation sub-assembly configured to fluidly connect or fluidically isolate the fluid tubing.

11. The reamer drill bit of claim 10, wherein the actuation sub-assembly comprises an activation port configured to open or close.

12. The reamer drill bit of claim 11, wherein the actuation sub-assembly is configured to fluidly connect or fluidically isolate the fluid tubing based on a received signal.

13. The reamer drill bit of claim 1, wherein the plurality of outlets comprise a first outlet defined in the first recess of the body.

14. The reamer drill bit of claim 13, wherein the plurality of outlets comprise a second outlet defined in a second recess of the outer surface of the body, wherein the first and second recess are axially aligned on the outer surface, wherein the arm covers the first and second recesses.

15. The reamer drill bit of claim 1, wherein the plurality of outlets are arranged between the first end and the second end of the body, wherein the body further comprises at least one nozzle at the second end of the body fluidly connected to the fluid source.

16. The reamer drill bit of claim 1, wherein the at least a portion of the outer surface of the body is a toothed pattern.

17. The reamer drill bit of claim 1, wherein the cutter arms have a retracted diameter in the first position and an extended diameter in a second position, wherein the cutter arms are biased towards the first position.

18. A method comprising:

providing a cutter arm of a reamer drill bit connected to a body of the reamer drill bit, wherein the cutter arm extends from a location between a first end and a second end of the body to a location past the second end of the body, wherein the reamer drill bit has a free end, wherein the cutter arm comprises an interior surface slidably attached to the body, a first cutting surface opposite the interior surface, and a second cutting surface perpendicular to the interior surface; and flowing pressurized fluid into a fluid channel defined in the body of the reamer drill bit, wherein the fluid channel extends to at least one outlet at an outer surface of the body of the reamer drill bit, wherein the outlet is arranged between the first end of the body and the second end of the body, wherein the interior surface of the cutter arm covers the outlet in a first position.

19. The method of claim 18, wherein flowing pressurized fluid into a fluid channel comprises receiving an actuation signal.

20. The method of claim 19, wherein flowing pressurized fluid into a fluid channel comprises fluidly connecting a fluid source to the at least one outlet at the outer surface of the body.

21. The method of claim 18, wherein flowing pressurized fluid into a fluid channel comprises opening an actuation port to fluidly connect a plurality of fluid channels to the fluid source.

22. The method of claim 18, further comprising translating the reamer drill bit such that the cutter arm receives a downhole force that translates the cutter arm along a sloped section of the body.

23. The method of claim 18, wherein flowing pressurized fluid into the fluid channel defined in the body of the reamer drill bit, comprises increasing the pressure of the pressurized fluid by 300 psi to 750 psi.

24. The method of claim 18, further comprising:

flowing the pressurized fluid to a nozzle disposed on the second end of the body; and spraying the pressurized fluid, by the nozzle, to an exterior of the reamer drill bit.

25. The method of claim 18, wherein flowing pressurized fluid into the fluid channel defined in the body of the reamer drill bit presses the cutter arm into a second position.

26. The method of claim 25, wherein the reamer drill bit is centered on an axis, wherein the cutter arm is radially farther from the axis in the second position than in the first position.

27. The method of claim 26, further comprising ceasing the flow of pressurized fluid by closing an actuation port.

* * * * *